US005473701A

United States Patent [19]

Cezanne et al.

[11] Patent Number: 5,473,701

[45] Date of Patent: Dec. 5, 1995

[54] ADAPTIVE MICROPHONE ARRAY

[75] Inventors: Juergen Cezanne, New Providence; Gary W. Elko, Summit, both of N.J.

[73] Assignee: AT&T Corp., Murray Hill, N.J.

[21] Appl. No.: 148,750

[22] Filed: Nov. 5, 1993

[51] Int. Cl.[6] ..... H04R 3/00

[52] U.S. Cl. ..... 381/92; 381/94

[58] Field of Search ..... 381/92, 94; 367/121, 367/123, 125

[56] References Cited

U.S. PATENT DOCUMENTS

| | | | |
|---|---|---|---|
| 4,485,484 | 11/1984 | Flanagan | 381/92 |
| 4,536,887 | 8/1985 | Kaneda et al. | 381/92 |
| 4,653,102 | 3/1987 | Hansen | 381/94 |
| 4,802,227 | 1/1989 | Elko et al. | 381/94 |
| 4,956,867 | 9/1990 | Zurek et al. | 381/94.1 |
| 5,267,320 | 11/1993 | Fukumizu | 381/94 |

OTHER PUBLICATIONS

European Search Report dated Feb. 21, 1995, corresponding European Patent Application 94307855.0.

L. J. Griffiths et al., "An Alternative Approach to Linearly Constrained Adaptive Beamforming," *IEEE Trans. Antennas Propag.*, vol. AP–30, 27–34 (Jan. 1982).

O. L. Frost III, "An Algorithm for Linearly Constrained Adaptive Array Processing," *Proc. IEEE*, vol. 60, 926–935 (Aug. 1972).

L. J. Griffiths, "A Simple Adaptive Algorithm for Real–Time Processing in Antenna Arrays," *Proc. IEEE*, vol. 57, 1696–1704 (Oct. 1969).

*Primary Examiner*—Stephen Brinich
*Attorney, Agent, or Firm*—Thomas A. Restaino

[57] ABSTRACT

The present invention is directed to a method of apparatus of enhancing the signal-to-noise ratio of a microphone array. The array includes a plurality of microphones and has a directivity pattern which is adjustable based on one or more parameters. The parameters are evaluated so as to realize an angular orientation of a directivity pattern null. This angular orientation of the directivity pattern null reduces microphone array output signal level. Parameter evaluation is performed under a constraint that the null be located within a predetermined region of space. Advantageously, the predetermined region of space is a region from which undesired acoustic energy is expected to impinge upon the array, and the angular orientation of a directivity pattern null substantially aligns with the angular orientation of undesired acoustic energy. Output signals of the array microphones are modified based on one or more evaluated parameters. An array output signal is formed based on modified and unmodified microphone output signals. The evaluation of parameters, the modification of output signals, and the formation of an array output signal may be performed a plurality of times to obtain an adaptive army response. Embodiments of the invention include those having a plurality of directivity patterns corresponding to a plurality of frequency subbands. Illustratively, the array may comprise a plurality of cardioid sensors.

23 Claims, 6 Drawing Sheets

ADAPTIVE MICROPHONE ARRAY

FIELD OF THE INVENTION

This invention relates to microphone arrays which employ directionality characteristics to differentiate between sources of noise and desired sound sources.

BACKGROUND OF THE INVENTION

Wireless communication devices, such as cellular telephones and other personal communication devices, enjoy widespread use. Because of their portability, such devices are finding use in very noisy environments. Users of such wireless communication devices often find that unwanted noise seriously detracts from clear communication of their own speech. A person with whom the wireless system user speaks often has a difficult time hearing the user's speech over the noise.

Wireless devices are not the only communication systems exposed to unwanted noise. For example, video teleconferencing systems and multimedia computer communication systems suffer similar problems. In the cases of these systems, noise within the conference room or office in which such systems sit detract from the quality of communicated speech. Such noise may be due to electric equipment noise (e.g., cooling fan noise), conversations of others, etc.

Directional microphone arrays have been used to combat the problems of noise in communication systems. Such arrays exhibit varying sensitivity to sources of noise as a function of source angle. This varying sensitivity is referred to as a directivity pattern. Low or reduced array sensitivity at a given source angle (or range of angles) is referred to a directivity pattern null. Directional sensitivity of an array is advantageously focused on desired acoustic signals and ignores, in large part, undesirable noise signals.

While conventional directional arrays provide a desirable level of noise rejection, they may be of limited usefulness in situations where noise sources move in relation to the array.

SUMMARY OF THE INVENTION

The present invention provides a technique for adaptively adjusting the directivity of a microphone array to reduce (for example, to minimize) the sensitivity of the array to background noise.

In accordance with the present invention, the signal-to-noise ratio of a microphone array is enhanced by orienting a null of a directivity pattern of the array in such a way as to reduce microphone array output signal level. Null orientation is constrained to a predetermined region of space adjacent to the array. Advantageously, the predetermined region of space is a region from which undesired acoustic energy is expected to impinge upon the array. Directivity pattern (and thus null) orientation is adjustable based on one or more parameters. These one or more parameters are evaluated under the constraint to realize the desired orientation. The output signals of one or more microphones of the array are modified based on these to evaluated parameters and the modified output signals are used in forming an array output signal.

An illustrative embodiment of the invention includes an array having a plurality of microphones. The directivity pattern of the array (i.e., the angular sensitivity of the array) may be adjusted by varying one or more parameters. According to the embodiment, the signal-to-noise ratio of the array is enhanced by evaluating the one or more parameters which correspond to advantageous angular orientations of one or more directivity pattern nulls. The advantageous orientations comprise a substantial alignment of the nulls with sources of noise to reduce microphone array output signal level due to noise. The evaluation of parameters is performed under a constraint that the orientation of the nulls be restricted to a predetermined angular region of space termed the background. The one or more evaluated parameters are used to modify output signals of one or more microphones of the array to realize null orientations which reduce noise sensitivity. An array output signal is formed based on one or more modified output signals and zero or more unmodified microphone output signals.

DETAILED DESCRIPTION

A. Introduction

Each illustrative embodiment discussed below comprises a microphone array which exhibits differing sensitivity to sound depending on the direction from which such sound impinges upon the array. For example, for undesired sound impinging upon the array from a selected angular region of space termed the background, the embodiments provide adaptive attenuation of array response to such sound impinging on the array. Such adaptive attenuation is provided by adaptively orienting one or more directivity pattern nulls to substantially align with the angular orientation(s) from which undesired sound impinges upon the array. This adaptive orientation is performed under a constraint that angular orientation of the null(s) be limited to the predetermined background.

For sound not impinging upon the array from an angular orientation within the background region, the embodiments provide substantially unattenuated sensitivity. The region of space not the background is termed the foreground. Because of the difference between array response to sound in the background and foreground, it is advantageous to physically orient the array such that desired sound impinges on the array from the foreground while undesired sound impinges on the array from the background.

FIG. 1 presents three representations of illustrative background and foreground configurations in two dimensions. In FIG. 1(*a*), the foreground is defined by the shaded angular region $-45°<\theta<45°$. The letter "A" indicates the position of the array (i.e., at the origin), the letter "x" indicates the position of the desired source, and letter "y" indicates the position of the undesired noise source. In FIG. 1(*b*), the foreground is defined by the angular region $-90°<\theta<90°$. In FIG. 1(*c*), the foreground is defined by the angular region $-160°<\theta<120°$. The foreground/background combination of FIG. 1(*b*) is used with the illustrative embodiments discussed below. As such, the embodiments are sensitive to desired sound from the angular region $-90°<\theta<90°$ (foreground) and can adaptively place nulls within the region $90°<\theta<270°$ to mitigate the effects of noise from this region (background).

Figure 2:
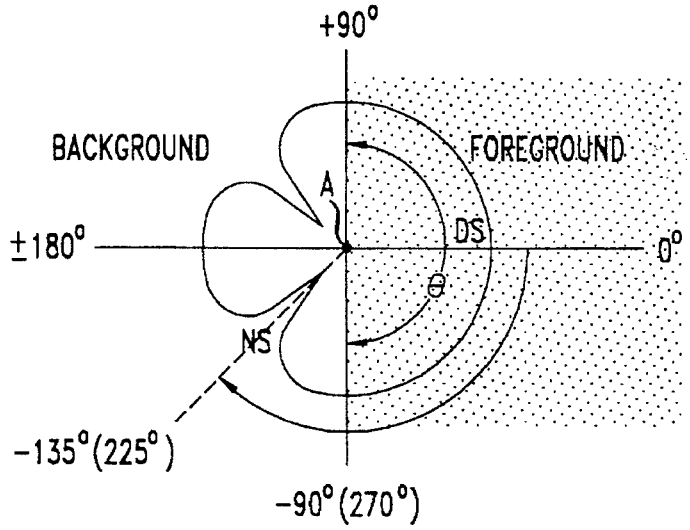
FIG. 2 presents an illustrative sensitivity pattern of an array in accordance with the present invention.

FIG. 2 presents an illustrative directivity pattern of an array shown in two-dimensions in accordance with the present invention. The sensitivity pattern is superimposed on the foreground/background configuration of FIG. 2(*b*). As shown in FIG. 2, array A has a substantially uniform sensitivity (as a function of $\theta$) in the foreground region to the desired source of sound DS. In the background region, however, the sensitivity pattern exhibits a null at approximately $180°\pm45°$, which is substantially coincident with the two-dimensional angular position of the noise source NS. Because of this substantial coincidence, the noise source NS contributes less to the array output relative to other sources not aligned with the null. The illustrative embodiments of the present invention automatically adjust their directivity patterns to locate pattern nulls in angular orientations to mitigate the effect of noise on array output. This adjustment is made under the constraint that the nulls be limited to the background region of space adjacent to the array. This constraint prevents the nulls from migrating into the foreground and substantially affecting the response of the array to desired sound.

As stated above, FIG. 2 presents a directivity pattern in two-dimensions. This two-dimensional perspective is a projection of a three-dimensional directivity pattern onto a plane in which the array A lies. Thus, the sources DS and NS may lie in the plane itself or may have two-dimensional projections onto the plane as shown. Also, the illustrative directivity pattern null is shown as a two-dimensional projection. The three-dimensional directivity pattern may be envisioned as a three-dimensional surface obtained by rotating the two-dimensional pattern projection about the $0°-180°$ axis. In three dimensions, the illustrative null may be envisioned as a cone with the given angular orientation, $180°\pm45°$. While directivity patterns are presented in two-dimensional space, it will be readily apparent to those of skill in the art that the present invention is generally applicable to three-dimensional arrangements of arrays, directivity patterns, and desired and undesired sources.

In the context of the present invention, there is no requirement that desired sources be located in the foreground or that undesired sources be located in the background. For example, as stated above the present invention has applicability to situations where desired acoustic energy impinges upon the array A from any direction within the foreground region (regardless of the location of the desired source(s)) and where undesired acoustic energy impinges on the array from any direction within the background region (regardless of the location of the undesired source(s)). Such situations may be caused by, e.g., reflections of acoustic energy (for example, a noise source not itself in the background may radiate acoustic energy which, due to reflection, impinges upon the array from some direction within the background). The present invention has applicability to still other situations where, e.g., both the desired source and the undesired source are located in the background (or the foreground). Embodiments of the invention would still adapt null position (constrained to the background) to reduce array output. Such possible configurations and situations notwithstanding, the illustrative embodiments of the present invention are presented in the context of desired sources located in the foreground and undesired sources located in the background for purposes of inventive concept presentation clarity.

The illustrative embodiments of the present invention are presented as comprising individual functional blocks (including functional blocks labeled as "processors") to aid in clarifying the explanation of the invention. The functions these blocks represent may be provided through the use of either shared or dedicated hardware, including, but not limited to, hardware capable of executing software. For example, the functions of blocks presented in FIGS. 3, 7, 8, 10, 11 and 12 may be provided by a single shared processor. (Use of the term "processor" should not be construed to refer exclusively to hardware capable of executing software.)

Illustrative embodiments may comprise digital signal processor (DSP) hardware, such as the AT&T DSP16 or DSP32C, read-only memory (ROM) for storing software performing the operations discussed below, and random access memory (RAM) for storing DSP results. Very large scale integration (VLSI) hardware embodiments, as well as custom VLSI circuitry in combination with a general purpose DSP circuit, may also be provided.

B. A First Illustrative Embodiment

Figure 3:
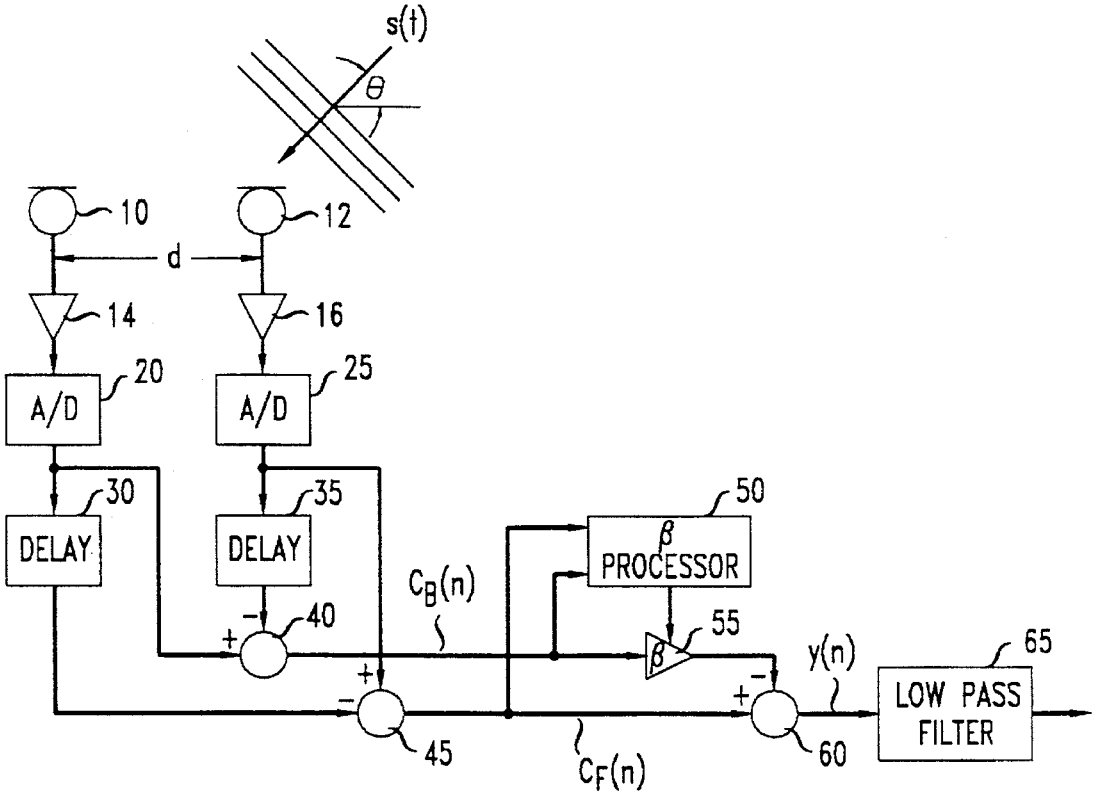
FIG. 3 presents an illustrative embodiment of the present invention.

FIG. 3 presents an illustrative embodiment of the present invention. In this embodiment, a microphone array is formed from back-to-back cardioid sensors. Each cardioid sensor is formed by a differential arrangement of two omnidirectional microphones. The microphone array receives a plane-wave acoustic signal, s(t), incident to the array at angle $\theta$.

As shown in the Figure, the embodiment comprises a pair of omnidirectional microphones 10, 12 separated by a distance, d. The microphones of the embodiment are Bruel & Kjaer Model 4183 microphones. Distance d is 1.5 cm. Each microphone 10, 12 is coupled to a preamplifier 14,16, respectively. Preamplifier 14, 16 provides 40 dB of gain to the microphone output signal.

The output of each preamplifier 14, 16 is provided to a conventional analog-to-digital (A/D) converter 20, 25. The A/D converters 20,25 convert analog microphone output signals into digital signals for use in the balance of the embodiment. The sampling rate employed by the A/D converters 20, 25 is 22.05 kHz.

Delay lines 30, 25 introduce signal delays needed to form the cardioid sensors of the embodiment. Subtraction circuit 40 forms the back cardioid output signal, $c_B(t)$, by subtracting a delayed output of microphone 12 from an undelayed output of microphone 10. Subtraction circuit 45 forms the front cardioid output signal, $c_F(t)$, by subtracting a delayed output of microphone 10 from an undelayed output of microphone 12.

As stated above, the sampling rate of the A/D converters 20, 25 is 22.05 kHz. This rate allows advantageous formation of back-to-back cardioid sensors by appropriately subtracting present samples from previous samples. By setting the sampling period of the A/D converters to d/c, where d is the distance between the omni-directional microphones and c is the speed of sound, successive signal samples needed to form each cardioid sensor are obtained from the successive samples from the A/D converter.

The output signals from the subtraction circuits 40, 45 are provided to β processor 50. β processor 50 computes a gain β for application to signal $c_B(t)$ by amplifier 55. The scaled signal, $\beta c_B(t)$, is then subtracted from front cardioid output signal, $c_F(t)$, by subtraction circuit 60 to form array output signal, y(t).

Output signal y(t) is then filtered by lowpass filter 65. Lowpass filter 65 has a 5 kHz cutoff frequency. Lowpass filter 65 is used to attenuate signals that are above the highest design frequency for the array.

The forward and backward facing cardioid sensors may be described mathematically with a frequency domain representation as follows:

$$C_F(\omega,\theta) = 2jS(\omega)e^{-j\omega T/2}\sin\frac{kd(1+\cos\theta)}{2} \tag{1}$$

and, $$C_B(\omega,\theta) = 2jS(\omega)e^{-j\omega T/2}\sin\frac{kd(1-\cos\theta)}{2}. \tag{2}$$

and the spatial origin is at the array center. Normalizing the array output signal by the input signal spectrum, S(ω), results in the following expression:

$$\left|\frac{Y(\omega,\theta)}{S(\omega)}\right| = 2\left|\sin\frac{kd(1+\cos\theta)}{2} - \beta\sin\frac{kd(1-\cos\theta)}{2}\right| \tag{3}$$

C. Determination of β

As shown in FIG. 3, the illustrative embodiment of the present invention includes a β processor 50 for determining the scale factor β used in adjusting the directivity pattern of the array. To allow the array to advantageously differentiate between desired foreground sources of acoustic energy and undesirable background noise sources, directivity pattern nulls are constrained to be within a defined spatial region. In the illustrative embodiment, the desired source of sound is radiating in the front half-plane of the array (that is, the foreground is defined by $-90<\theta<90$). The undesired noise source is radiating in the rear half-plane of the array (that is, the background is defined by $90<\theta<270$). β processor 50 first computes a value for β and then constrains β to be $0<\beta<1$ which effectuates a limitation on the placement of a directivity pattern null to be in the rear half-plane. For the first illustrative embodiment, $\theta_{null}$, the angular orientation of a directivity pattern null, is related to β as follows:

$$\theta_{null} = \arccos\left(1 - \frac{2}{kd}\arctan\left[\frac{\sin(kd)}{\beta+\cos(kd)}\right]\right). \tag{4}$$

Note that for $\beta=1$, $\theta_{null}=90°$ and for $\beta=0$, $\theta_{null}=180°$.

A value for β is computed by β processor 50 according to any of the following illustrative relationships.

1. Optimum β

The optimum value of β is defined as that value of β which minimizes the mean square value of the array output. The output signal of the illustrative back-to-back cardioid embodiment is:

$$y(n)=c_F(n)-\beta c_B(n). \tag{5}$$

The value of β determined by processor 50 which minimizes array output is:

$$\beta = \frac{1/N\sum_{n=0}^{n=N-1} c_B(n)c_F(n)}{1/N\sum_{n=0}^{n=N-1} c_B^2(n)}. \tag{6}$$

This result for optimum β is a finite time estimate of the optimum Wiener filter for a filter of length one.

2. Updating β with LMS Adaptation

Values for β may be obtained using a least mean squares (LMS) adaptive scheme. Given the output expression for the back-to-back cardioid array of FIG. 3, $$y(n)=c_F(n)-\beta c_B(n) \tag{7}$$

the LMS update expression for β is $$\beta(n+1)=\beta(n)+2\mu y(n)c_B(n), \tag{8}$$

where μ is the update step-size ($\mu<1$; the larger the μ the faster the convergence). The LMS update may be modified to include a normalized update step-size so that explicit convergence bounds for μ may be independent of the input power. The LMS update of β with a normalized μ is:

$$\beta(n+1) = \beta(n) + 2\mu y(n)\frac{c_B(n)}{\langle c_B^2(n)\rangle}, \tag{9}$$

where the brackets indicate a time average, and where if $\langle c_B^2(n)\rangle$ is close to zero, the quotient is not formed and μ is set to zero.

3. Updating β with Newton's Technique

Newton's technique is a special case of LMS where μ is a function of the input. The update expression for β is:

$$\beta(n+1) = \beta(n) + \frac{y(n)}{c_B(n)}, \tag{10}$$

where $c_B(n)$ is not equal to zero. The noise sensitivity of this system may be reduced by introducing a constant multiplier $0\leqq\mu\leqq1$ to the update term, $y(n)/c_B(n)$.

D. A Software Implementation of the First Embodiment

Figure 4:
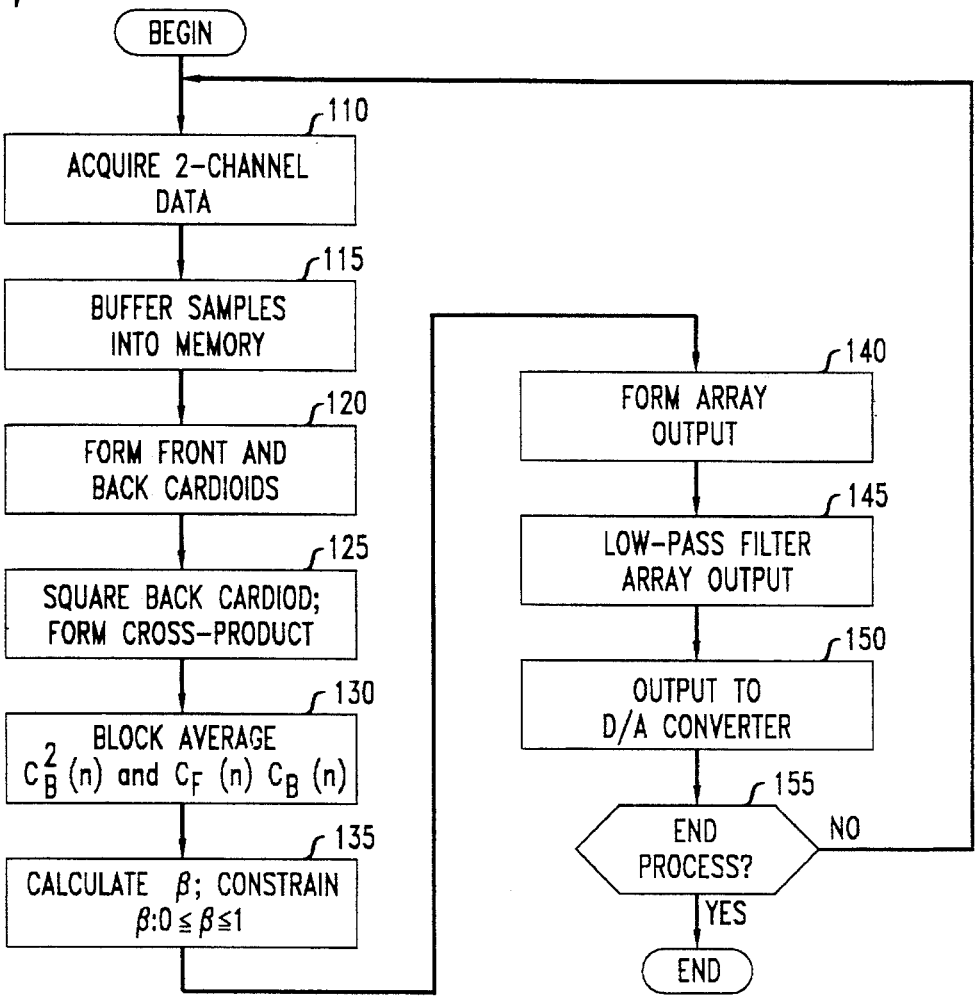
FIG. 4 presents a flow diagram of software for implementing a third embodiment of the present invention.

While the illustrative embodiment presented above may be implemented largely in hardware as described, the embodiment may be implemented in software running on a DSP, such as the AT&T DSP32C, as stated above. FIG. 4 presents a flow diagram of software for implementing a second illustrative embodiment of the present invention for optimum β.

According to step 110 of FIG. 4, the first task for the DSP is to acquire from each channel (i.e., from each A/D converter associated with a microphone) a sample of the microphone signals. These acquired samples (one for each channel) are current samples at time n. These sample are buffered into memory for present and future use (see step 115). Microphone samples previously buffered at time n−1 are made available from buffer memory. Thus, the buffer memory serves as the delay utilized for forming the cardioid sensors.

Next, both the front and back cardioid output signal samples are formed (see step 120). The front cardioid sensor signal sample, $c_F(n)$, is formed by subtracting a delayed sample (valid at time n−1) from the back microphone (via a buffer memory) from a current sample (valid at time n) from the front microphone. The back cardioid sensor signal sample, $c_B(n)$, is formed by subtracting a delayed sample (valid at time n−1) from the front microphone (via a buffer memory) from a current sample (valid at time n) from the back microphone.

The operations prefatory to the computation of scale factor β are performed at steps 125 and 130. Signals $c_B^2(n)$ and $c_F(n)c_B(n)$ are first computed (step 125). Each of these signals is then averaged over a block of N samples, where N is illustratively 1,000 samples (step 130). The size of N affects the speed of null adaptation to moving sources of noise. Small values of N can lead to null adaptation jitter, while large values of N can lead to slow adaptation rates. Advantageously, N, should be chosen as large as possible while maintaining sufficient null tracking speed for the given application.

At step 135, the block average of the cross-product of back and front cardioid sensor signals is divided by the block average of the square of the back cardioid sensor signal. The result is the ratio, β, as described in expression (6). The value of β is then constrained to be within the range of zero and one. This constraint is accomplished by setting β=1 if β is calculated to be a number greater than one, and setting β=0 if β is calculated to be a number less than zero. By constraining β in this way, the null of the array is constrained to be in the rear half-plane of the array's sensitivity pattern.

The output sample of the array, y(n), is formed (step 140) in two steps. First, the back cardioid signal sample is scaled by the computed and constrained (if necessary) value of β. Second, the scaled back cardioid signal sample is subtracted from the front cardioid signal sample.

Output signal y(n) is then filtered (step 145) by a lowpass filter having a 5 kHz cutoff frequency. As stated above, the lowpass filter is used to attenuate signals that are above the highest design frequency for the array. The filtered output signal is then provided to a D/A converter (step 150) for use by conventional analog devices. The software process continues (step 155) if there is a further input sample from the A/D converters to process. Otherwise, the process ends.

E. An Illustrative Analog Embodiment

Figure 5:
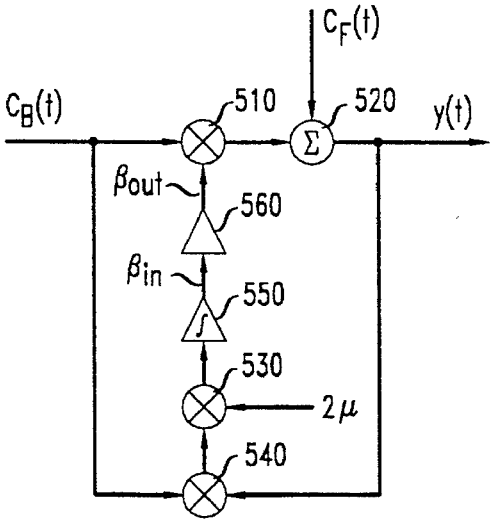
FIG. 5 presents a third illustrative embodiment of the present invention.
Figure 6A:
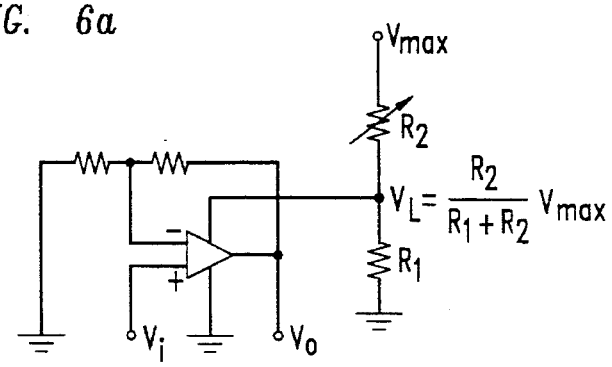
FIGS. 6(*a*) and 6(*b*) present analog circuitry for implementing β saturation of the embodiment of FIG. 5 and its input/output characteristic, respectively.
Figure 6B:
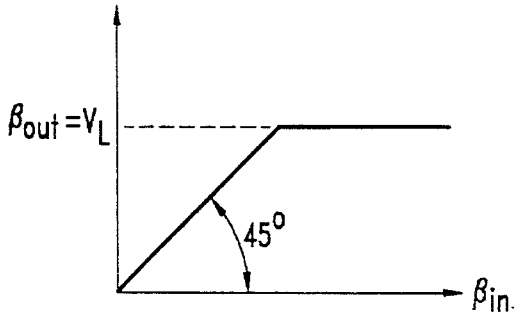

The present invention may be implemented with analog components. FIG. 5 presents such an illustrative implementation comprising conventional analog multipliers 510, 530, 540, an analog integrator 550, an analog summer 520, and a non-inverting amplifier circuit 560 shown in FIG. 6(*a*) having input/output characteristic shown in FIG. 6(*b*) (wherein the saturation voltage $V_L=\beta$ is set by the user to define the foreground/background relationship). Voltage $V_L$ is controlled by a potentiometer setting as shown. The circuit of FIG. 5 operates in accordance with continuous-time versions of equations (7) and (8), wherein β is determined in an LMS fashion.

F. A Fourth Illustrative Embodiment

A fourth illustrative embodiment of the present invention is directed to a subband implementation of the invention. The embodiment may be advantageously employed in situations where there are multiple noise sources radiating acoustic energy at different frequencies. According to the embodiment, each subband has its own directivity pattern including a null. The embodiment computes a value for β (or a related parameter) on a subband-by-subband basis. Parameters are evaluated to provide an angular orientation of a given subband null. This orientation helps reduce microphone array output level by reducing the array response to noise in a given subband. The nulls of the individual subbands are not generally coincident, since noise sources (which provide acoustic noise energy at differing frequencies) may be located in different angular directions. However there is no reason why two or more subband nulls cannot be substantially coincident.

Figure 7:
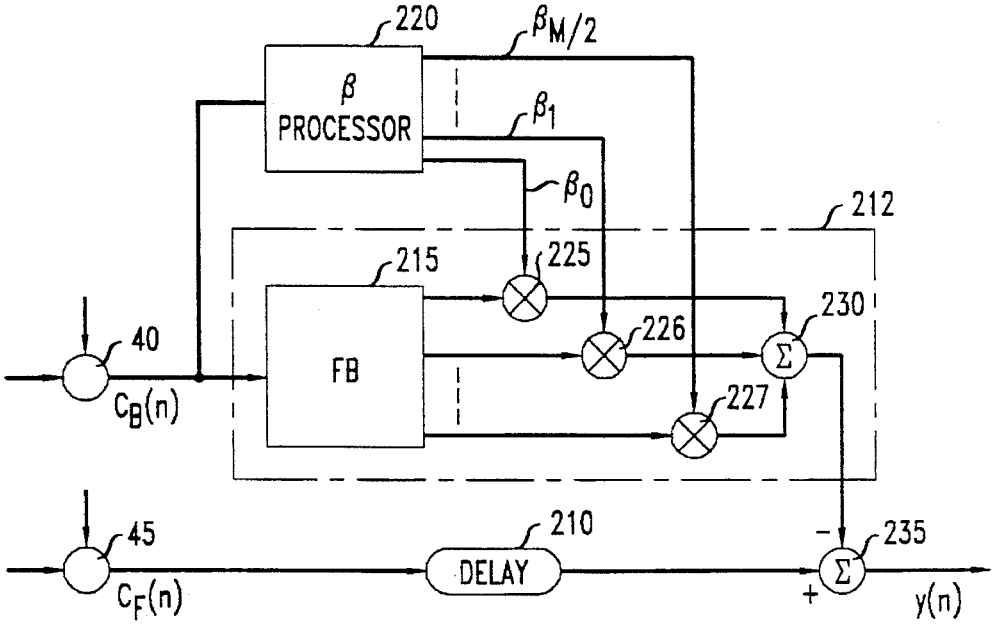
FIG. 7 presents a fourth illustrative embodiment of the present invention.

The fourth illustrative embodiment of the present invention is presented in FIG. 7. The embodiment is identical to that of FIG. 3 insofar as the microphones 10, 12, preamplifiers 14, 16, A/D converters 20, 25, and delays 30, 35 are concerned. These components are not repeated in FIG. 7 so as to clarify the presentation of the embodiment. However, subtraction circuits 40, 45 are shown for purposes of orienting the reader with the similarity of this fourth embodiment to that of FIG. 3.

As shown in the Figure, the back cardioid sensor output signal, $c_B(n)$, is provided to a β-processor 220 as well as a filterbank 215. Filterbank 215 resolves the signal $c_B(n)$ into M/2+1 subband component signals. Each subband component signal is scaled by a subband version of β. The scaled subband component signals are then summed by summing circuit 230. The output signal of summing circuit 230 is then subtracted from a delayed version of the front cardioid sensor output signal, $c_F(n)$, to form array output signal, y(n). Illustratively, M=32. The delay line 210 is chosen to realize a delay commensurate with the processing delay of the branch of the embodiment concerned with the back cardioid output signal, $c_B(n)$.

Figure 8:
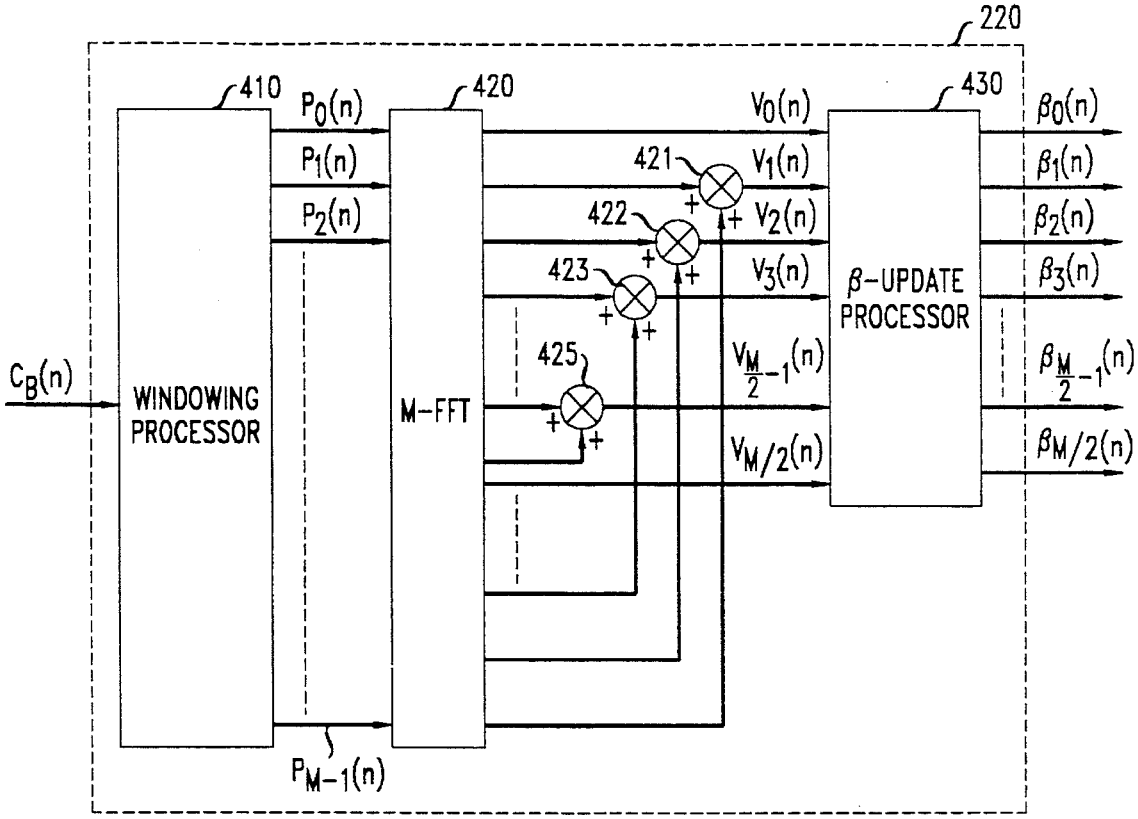
FIG. 8 presents a polyphase filterbank implementation of a β computer presented in FIG. 7.

The β-processor 220 of FIG. 7 comprises a polyphase filterbank as illustrated in FIG. 8.

Figure 9:
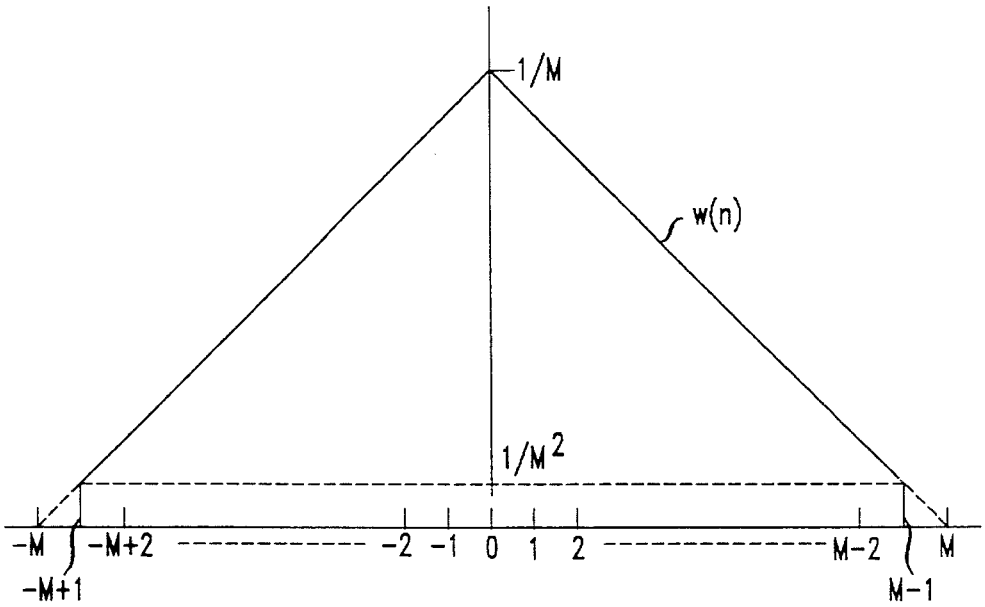
FIG. 9 presents an illustrative window of coefficients for use by the windowing processor presented in FIG. 8.

As shown in FIG. 8, the back cardioid sensor output signal, $c_B(n)$, is applied to windowing processor 410. Windowing processor applies a window of coefficients presented in FIG. 9 to incoming samples of $c_B(n)$ to form the M output signals, $p_m(n)$, shown in FIG. 8. Windowing processor 410 comprises a buffer for storing 2M−1 samples of $c_B(n)$, a read-only memory for storing window coefficients, w(n), and a processor for forming the products/sums of coefficients and signals. Windowing processor 410 generates signals $p_m(n)$ according to the following relationships:

$$p_0(n)=c_B(n-M)w(0)$$

$$p_1(n)=c_B(n-1)w(-M+1)+c_B(n-M-1)w(1)$$

$$p_2(n)=c_B(n-2)w(-M+2)+c_B(n-M-2)w(2)$$

$$p_{M-1}(n)=c_B(n-M+1)w(-1)+c_B(n-2M+1)w(m-1). \quad (11)$$

The output signals of windowing processor 410, $p_m(n)$, are applied to Fast Fourier Transform (FFT) processor 420. Processor 420 takes a conventional M-point FFT based on the M signals $p_m(n)$. What results are M FFT signals. Of these signals, two are real valued signals and are labeled as $v_0(n)$ and $v_{M/2}(n)$. Each of the balance of the signals is complex. Real valued signals, $v_1(n)$ through $v_{M/2-1}(n)$ are formed by the sum of an FFT signal and its complex conjugate, as shown in the FIG. 8.

Real-valued signals $v_0(n), \ldots, v_{M/2}(n)$ are provided to β-update processor 430. β-update processor 430 updates values of β for each subband according to the following relation:

$$\beta_m(n+1)=\beta_m(n)+\mu y(n)\frac{v_m(n)}{\sum_{m=0}^{M/2} v_m^2(n)}, \quad (12)$$

where μ is the update stepsize, illustratively 0.1 (however, μ may be set equal to zero and the quotient not formed when the denominator of (12) is close to zero). The updated value of $\beta_m(n)$ is then saturated as discussed above. That is, for 0<m<M/2, $$\beta_m(n+1)=\begin{cases}\beta_m(n+1) & \text{if } 0<\beta_m(n+1)<1\\ 1 & 1<\beta_m(n+1)\\ 0 & 0>\beta_m(n+1)\end{cases} \quad (13)$$

Advantageously, the computations described by expressions (11) through (13) are performed once every M samples to reduce computational load.

Figure 10:
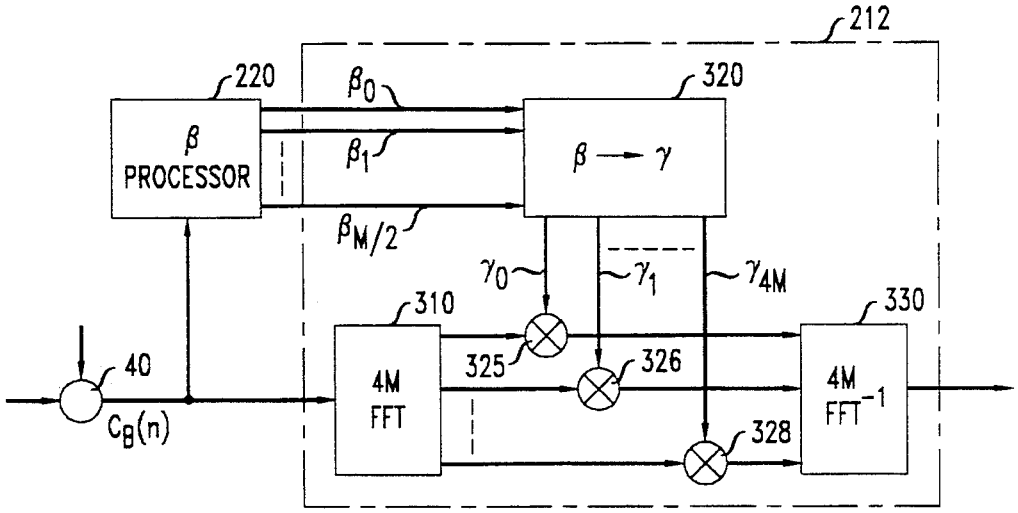
FIG. 10 presents a fast convolutional procedure implementing a filterbank and scaling and summing circuits presented in FIG. 7.
Figure 11:
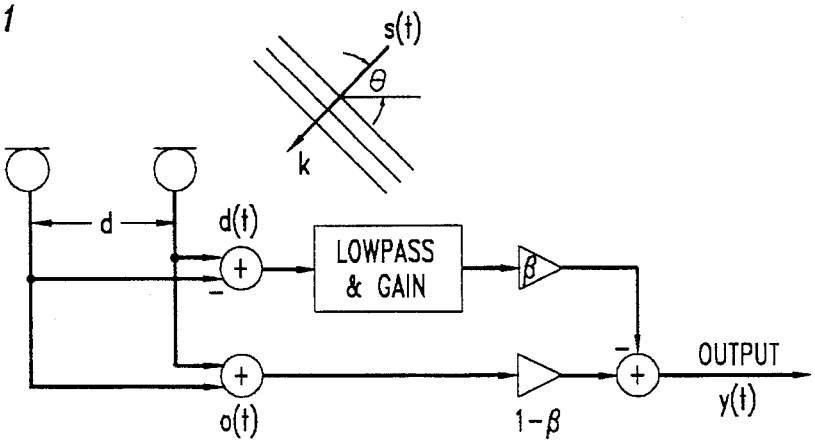
FIG. 11 presents a fifth illustrative embodiment of the present invention.
Figure 12:
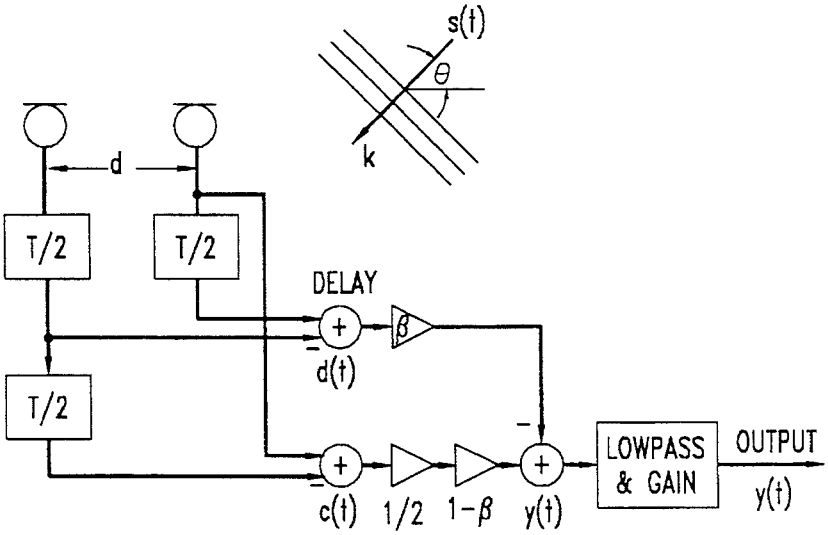
FIG. 12 presents a sixth illustrative embodiment of the present invention.

Those components which appear in the filterbank 215 and scaling and summing section 212 of FIG. 7 may be realized by a fast convolution technique illustrated by the block diagram of FIG. 10.

As shown in FIG. 10, β-processor provides the subband values of β to β-to-γ processor 320. β-to-γ processor 320 generates 4M fast convolution coefficients, γ, which are equivalent to the set of β coefficients from processor 430. The γ coefficients are generated by (i) computing an impulse response (of length 2M−1) of the filter which is block 212 (of FIG. 7) as a function of the values of β and (ii) computing the Fast Fourier Transform (FFT) (of size 4M) of the computed impulse response. The computed FFT coefficients are the 4M γ's. (Alternatively, due to the symmetry of the window used in the computation of the subband β values, there is a symmetry in the values of the γ coefficients which can be exploited to reduce the size of the FFT to 2M.)

The 4M γ coefficients are applied to a frequency domain representation of the back cardioid sensor signal, $c_B(n)$. This frequency domain representation is provided by FFT processor 310 which performs a 4M FFT. The 4M γ coefficients are used to scale the 4M FFT coefficients as shown in FIG. 10. The scaled FFT coefficients are then processed by $FFT^{-1}$ processor 330. The output of $FFT^{-1}$ processor 330 (and block 212) is then provided to the summing circuit 235 for subtraction from the delayed $c_F(n)$ signal (as shown in FIG. 7). The size of the FFT and $FFT^{-1}$ may also be reduced by exploiting the symmetry of the γ coefficients.

G. Alternative Embodiments

While the illustrative embodiments presented above concern back-to-back cardioid sensors, those of ordinary skill in the art will appreciate that other array configurations in accordance with the present invention are possible. One such array configuration comprises a combination of an omnidirectional sensor and a dipole sensor to form an adaptive first order differential microphone array. Such a combination is presented in FIG. 11. β is updated according to the following expression:

$$\beta(n+1)=\beta(n)+2\mu y(n)(d(n)+o(n)). \quad (14)$$

Another such array configuration comprises a combination of a dipole sensor and a cardioid sensor to again form an adaptive first order differential microphone array. Such a combination is presented in FIG. 12. β is updated according to the following expression:

$$\beta(n+1)=\beta(n)+2\mu y(n)(d(n)+c(n)). \quad (15)$$

Although a number of specific embodiments of this invention have been shown and described herein, it is to be understood that these embodiments are merely illustrative of the many possible specific arrangements which can be devised in application of the principles of the invention. Numerous and varied other arrangements can be devised in accordance with these principles by those of ordinary skill in the art without departing from the spirit and scope of the invention.

We claim:

1. A method of enhancing the signal-to-noise ratio of a microphone array, the array including a plurality of microphones and having a directivity pattern, the directivity pattern of the array being adjustable based on one or more parameters, the method comprising the steps of:

a. evaluating one or more parameters to realize an angular orientation of a directivity pattern null, which angular orientation reduces microphone array output signal level in accordance with a criterion, said evaluation performed under a constraint that the null be precluded from being located within a predetermined region of space which comprises a range of directions about the array, which range reflects a predetermined directional variability of the desired acoustic energy with respect to the array;

b. modifying output signals of one or more microphones of the array based on the one or more evaluated parameters; and c. forming an array output signal based on one or more modified output signals and zero or more unmodified microphone output signals.

2. The method of claim 1 wherein steps a, b, and c, are performed a plurality of times to obtain an adaptive array response.

3. The method of claim 1 wherein a region of space other than the predetermined region of space includes sources of undesired acoustic energy.

4. The method of claim 1 wherein undesired acoustic energy impinges on the array from a direction within a region of space other than the predetermined region of space.

5. The method of claim 1 wherein the array has a plurality of directivity patterns corresponding to a plurality of frequency subbands, one or more of the plurality of directivity patterns including a null.

6. The method of claim 5 further comprising the step of forming a plurality of subband microphone output signals based on an output signal of a microphone of the array, wherein the step of modifying output signals comprises modifying the subband microphone output signals based on the one or more evaluated parameters.

7. The method of claim 1 wherein the array comprises a plurality of cardioid sensors.

8. The method of claim 7 wherein the plurality of cardioid sensors comprises a foreground cardioid sensor and a background cardioid sensor and wherein the step of evaluating comprises determining a parameter reflecting a ratio of (i) a product of output signals of the foreground and background cardioid sensors to (ii) the square of the output signal of the background cardioid sensor.

9. The method of claim 7 wherein the plurality of cardioid sensors comprises a foreground cardioid sensor and a background cardioid sensor and wherein the step of evaluating comprises determining a scale factor for an output signal of the background cardioid sensor.

10. The method of claim 9 wherein the scale factor is determined based on an output signal of the background cardioid sensor and the array output signal.

11. An apparatus for enhancing the signal-to-noise ratio of a microphone array, the array including a plurality of microphones and having a directivity pattern, the directivity pattern of the array being adjustable based on one or more parameters, the apparatus comprising:

a. means for evaluating one or more parameters to realize an angular orientation of a directivity pattern null, which angular orientation reduces microphone array output signal level in accordance with a criterion, said evaluation performed under a constraint that the null be precluded from being located within a predetermined region of space which comprises a range of directions about the array which range reflects a predetermined directional variability of the desired acoustic energy with respect to the array;

b. means for modifying output signals of one or more microphones of the array based on the one or more evaluated parameters; and c. means for forming an array output signal based on one or more modified output signals and zero or more unmodified microphone output signals.

12. The apparatus of claim 11 wherein a region of space other than the predetermined region of space includes sources of undesired acoustic energy.

13. The apparatus of claim 11 wherein undesired acoustic energy impinges on the array from a direction within a region of space other than the predetermined region of space.

14. The apparatus of claim 11 wherein the array has a plurality of directivity patterns corresponding to a plurality of frequency subbands, one or more of the plurality of directivity patterns including a null.

15. The apparatus of claim 14 further comprising means for forming a plurality of subband microphone output signals based on an output signal of a microphone of the array, wherein the means for modifying output signals comprises means for modifying the subband microphone output signals based on the one or more evaluated parameters.

16. The apparatus of claim 14 wherein the means for evaluating comprises a polyphase filterbank.

17. The apparatus of claim 11 wherein the means for modifying comprises a means for performing fast convolution.

18. The apparatus of claim 11 wherein the array comprises a plurality of cardioid sensors.

19. The apparatus of claim 18 wherein the plurality of cardioid sensors comprises a foreground cardioid sensor and a background cardioid sensor and wherein the means for evaluating comprises means for determining a parameter reflecting a ratio of a (i) product of output signals of the foreground and background cardioid sensors to (ii) the square of the output signal of the background cardioid sensor.

20. The apparatus of claim 18 wherein the plurality of cardioid sensors comprises a foreground cardioid sensor and a background cardioid sensor and wherein the means for evaluating comprises means for determining a scale factor for an output signal of the background cardioid sensor.

21. The apparatus of claim 18 wherein the scale factor is determined based on an output signal of the background cardioid sensor and the array output signal.

22. The apparatus of claim 11 wherein the array comprises a cardioid sensor and a dipole sensor.

23. The apparatus of claim 11 wherein the array comprises a omnidirectional sensor and a dipole sensor.

* * * * *

US005473701C1

(12) EX PARTE REEXAMINATION CERTIFICATE (7375th)

United States Patent

Cezanne et al.

(10) Number: US 5,473,701 C1

(45) Certificate Issued: Feb. 23, 2010

(54) ADAPTIVE MICROPHONE ARRAY

(75) Inventors: Juergen Cezanne, New Providence, NJ (US); Gary W. Elko, Summit, NJ (US)

(73) Assignee: Agere Systems Guardian Corp., Orlando, FL (US)

Reexamination Request:
No. 90/010,371, Dec. 24, 2008

Reexamination Certificate for:

| | |
|---|---|
| Patent No.: | **5,473,701** |
| Issued: | **Dec. 5, 1995** |
| Appl. No.: | **08/148,750** |
| Filed: | **Nov. 5, 1993** |

(51) Int. Cl.

| | |
|---|---|
| ***H04R 3/00*** | (2006.01) |
| ***H04R 1/40*** | (2006.01) |

(52) U.S. Cl. ..... 381/92; 381/94.7

(58) Field of Classification Search ..... None
See application file for complete search history.

(56) References Cited

U.S. PATENT DOCUMENTS

| | | | |
|---|---|---|---|
| 4,485,484 | A | 11/1984 | Flanagan |
| 4,536,887 | A | 8/1985 | Kaneda et al. |
| 4,623,980 | A | 11/1986 | Vary |
| 4,653,102 | A | 3/1987 | Hansen |
| 4,723,294 | A | 2/1988 | Taguchi |
| 4,802,227 | A | 1/1989 | Elko |
| 4,866,777 | A | 9/1989 | Mulla |
| 4,888,807 | A | 12/1989 | Reichel |
| 4,918,524 | A | 4/1990 | Ansari et al. |
| 4,956,867 | A | 9/1990 | Zurek et al. |
| 5,172,597 | A | 12/1992 | Hedeen |
| 5,179,575 | A | 1/1993 | Pierce et al. |
| 5,267,320 | A | 11/1993 | Fukumizu |
| 5,270,953 | A | 12/1993 | White |
| 5,329,587 | A | 7/1994 | Morgan |

FOREIGN PATENT DOCUMENTS

| | | |
|---|---|---|
| EP | 0 337 025 | 10/1989 |
| GB | 1 534 379 | 12/1978 |
| JP | S59-64994 | 4/1984 |

OTHER PUBLICATIONS

L.J. Griffiths, et al, "An Alternative Approach to Linearly Constrained Adaptive Beamforming," *IEEE Transactions on Antennas and Propagation*, vol. AP–30, No. 1, pp. 27–34 (Jan. 1982).

Hoffman et al, "Constrained Optimum Filtering for Multi–Microphone Digital Hearing Aids", 24' ACSSC, 1990, p. 28–32.

Introduction to Adaptive Arrays, R.A. Monzingo & T.W. Miller, Wiley 1980 (Monzingo et al).

(Continued)

*Primary Examiner*—Colin M Larose

(57) ABSTRACT

The present invention is directed to a method [of] *and* apparatus of enhancing the signal-to-noise ratio of a microphone array. The array includes a plurality of microphones and has a directivity pattern which is adjustable based on one or more parameters. The parameters are evaluated so as to realize an angular orientation of a directivity pattern null. This angular orientation of the directivity pattern null reduces microphone array output signal level. Parameter evaluation is performed under a constraint that the null be located within a predetermined region of space. Advantageously, the predetermined region of space is a region from which undesired acoustic energy is expected to impinge upon the array, and the angular orientation of a directivity pattern null substantially aligns with the angular orientation of undesired acoustic energy. Output signals of the array microphones are modified based on one or more evaluated paramaters. An array output signal is formed based on modified and unmodified microphone output signals. The evaluation of parameters, the modification of output signals, and the formation of an array output signal may be performed a plurality of times to obtain an adaptive army response. Embodiments of the invention include those having a plurality of directivity patterns corresponding to a plurality of frequency subbands. Illustratively, the array may comprise a plurality of cardioid sensors.

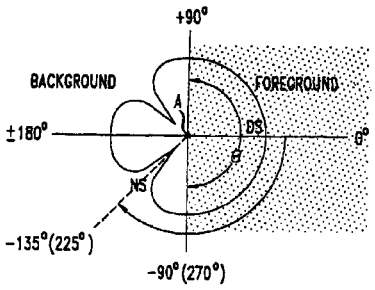

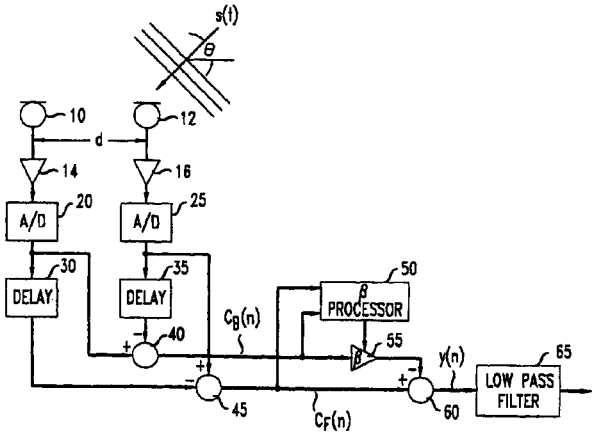

OTHER PUBLICATIONS

Adaptive Array Principles, J.E. Hudson, IEEE Electromagnetic Wave Series, vol. 11, 1981 (Hudson).
M.H. Er and A. Cantoni, "Derivative Constraints for Broad–Band Element Space Antanna Array Processors", IEEE Trans. ASSP, 31(6), 1983, p. 1378–1393 (Er et al).
Frost III, "An Algorithm for Linearly Constrained Adaptive Array Processing" Proceedings of the IEEE, 1972, vol. 60, No. 8, pp. 926–935.
Griffiths, "A Simple Adaptive Algorithm for Real–Time Processing in Antenna Arrays" Proceedings of the IEEE, 1969, vol. 57, No. 10, pp. 1696–1704.
Peterson et al., "Multimicrophone Adaptive Beamforming for Interference Reduction in Hearing Aids" Journal of Rehabilitation Research and Development, 1987, vol. 24, No. 4, pp. 103–110.

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Figure 1A:
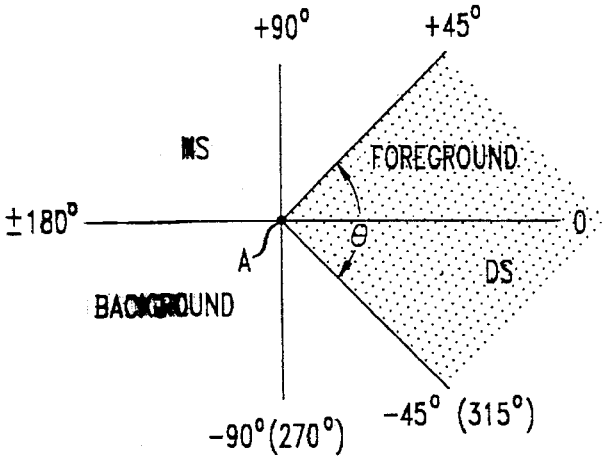
FIGS. 1(*a*)–1(*c*) present three representations of illustrative background and foreground configurations.
Figure 1B:
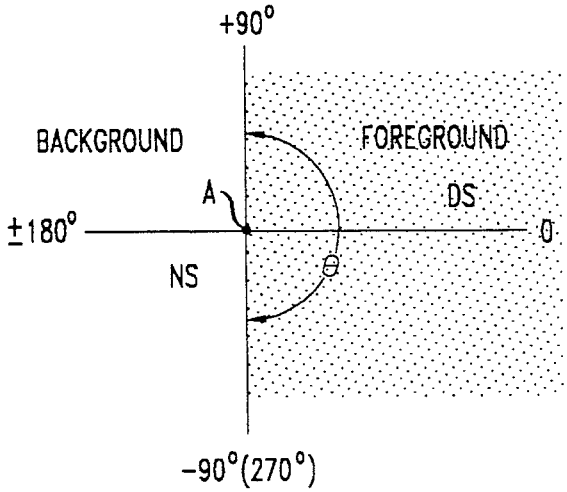
Figure 1C:
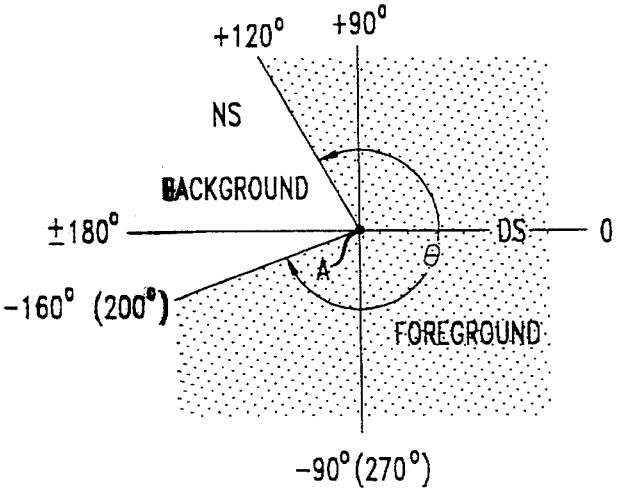

Column 3, lines 5–20:

FIG. 1 presents three representations of illustrative backgound and foreground configurations in two dimensions. In FIG. 1(a), the foreground is defined by the shaded angular region −45°>Θ>45°. The letter "A" indicates the position of the array (i.e., at the origin), the [letter "x" indicates] *letters "DS" indicate* the position of the desired source, and [letter "y" indicates] *the letters "NS" indicate* the position of the undesired noise source. In FIG. 1(b), the foregound is defined by the angular region −90>Θ>90°. In FIG. 1(c), the foreground is defined by the angular region −160°>Θ>120°. The foregound/background combination of FIG. 1(b) is used with the illustrative embodiments discussed below. As such, the embodiments are sensitive to desired sound from the angular region −90°>Θ°90°(foreground) and can adaptively place nulls within the region −90°>Θ>270°to mitigate the effects of noise from this region (background).

Column 3, lines 21–41:

FIG. 2 presents an illustrative directivity pattern of an array shown in two-dimensions in accordance with the present invention. The sensitivity pattern is superimposed on the foreground/background configuration of FIG. [2(b)] *1(b)*. As shown in FIG. 2, array A has a substantially uniform sensitivity (as a function of Θ) in the foreground region to the desired source of sound DS. In the background region, however, the sensitivity pattern exhibits a null at approximately 180°±45°, which is substantially coincident with the two-dimensional angular position of the noise source NS. Because of this substantial coincidence, the noise source NS contributes less to the array output relative to other sources not aligned with the null. The illustrative embodiments of the present invention automatically adjust their directivity patterns to locate pattern nulls in angular orientations to mitigate the effect of noise on array output. This adjustment is made under the constraint that the nulls be limited to the background region of space adjacent to the array. This constraint prevents the nulls from migrating into the foreground and substantially affecting the response of the array to the desired sound.

Column 4, lines 56–63:

Delay lines 30, [25] *35* introduce signal delays needed to form the cardioid sensors of the embodiment. Subtraction circuit 40 forms the back cardioid output signal, [$C_B$(t)] $C_B(n)$, by subtracting a delayed output of microphone 12 from an undelayed output of microphone 10. Subtraction circuit 45 forms the front cardioid output signal [$C_F$(t)] $C_F(n)$, by subtracting a delayed output of microphone 10 from an undelayed output of microphone 12.

Column 5, lines 6–11:

The output signals from the subtraction circuits 40, 45 are provided to β processor 50. β processor 50 computes a gain β for application to signal [$C_B$ (t)] $C_B(n)$ by amplifier 55. The scaled signal [β$C_B$(t)] β$C_B(n)$, is then subtracted from front cardioid output signal [$C_F$(t)] $C_F(n)$, by subtraction circuit 60 to form array output signal [y(t)] $y(n)$.

Column 5, lines 12–15:

Output signal [y(t)] $y(n)$ is then filtered by lowpass filter 65. Lowpass filter 65 has a 5 kHz cutoff frequency. Lowpass filter 65 is used to attenuate signals that are above the highest design frequency for the array.

AS A RESULT OF REEXAMINATION, IT HAS BEEN DETERMINED THAT:

The patentability of claims 1–23 is confirmed.

* * * * *

US005473701C2

(12) EX PARTE REEXAMINATION CERTIFICATE (9733rd)

United States Patent
Cezanne et al.

(10) Number: US 5,473,701 C2
(45) Certificate Issued: Jun. 28, 2013

(54) ADAPTIVE MICROPHONE ARRAY

(75) Inventors: Juergen Cezanne, New Providence, NJ (US); Gary W. Elko, Summit, NJ (US)

(73) Assignee: Adaptive Sonics LLC, Frisco, TX (US)

Reexamination Request:
No. 90/012,359, Jun. 15, 2012

Reexamination Certificate for:

| | |
|---|---|
| Patent No.: | **5,473,701** |
| Issued: | **Dec. 5, 1995** |
| Appl. No.: | **08/148,750** |
| Filed: | **Nov. 5, 1993** |

Reexamination Certificate C1 5,473,701 issued Feb. 23, 2010

(51) Int. Cl.
*H04R 3/00* (2006.01)
*H04R 1/40* (2006.01)

(52) U.S. Cl.
USPC ..... 381/92; 381/94.7

(58) Field of Classification Search
None
See application file for complete search history.

(56) References Cited

To view the complete listing of prior art documents cited during the proceeding for Reexamination Control Number 90/012,359, please refer to the USPTO's public Patent Application Information Retrieval (PAIR) system under the Display References tab.

*Primary Examiner* — Kenneth J Whittington

(57) ABSTRACT

The present invention is directed to a method and apparatus of enhancing the signal-to-noise ratio of a microphone array. The array includes a plurality of microphones and has a directivity pattern which is adjustable based on one or more parameters. The parameters are evaluated so as to realize an angular orientation of a directivity pattern null. This angular orientation of the directivity pattern null reduces microphone array output signal level. Parameter evaluation is performed under a constraint that the null be located within a predetermined region of space. Advantageously, the predetermined region of space is a region from which undesired acoustic energy is expected to impinge upon the array, and the angular orientation of a directivity pattern null substantially aligns with the angular orientation of undesired acoustic energy. Output signals of the army microphones are modified based on one or more evaluated paramaters. An array output signal is formed based on modified and unmodified microphone output signals. The evaluation of parameters, the modification of output signals, and the formation of an array output signal may be performed a plurality of times to obtain an adaptive army response. Embodiments of the invention include those having a plurality of directivity patterns corresponding to a plurality of frequency subbands. Illustratively, the array may comprise a plurality of cardioid sensors.

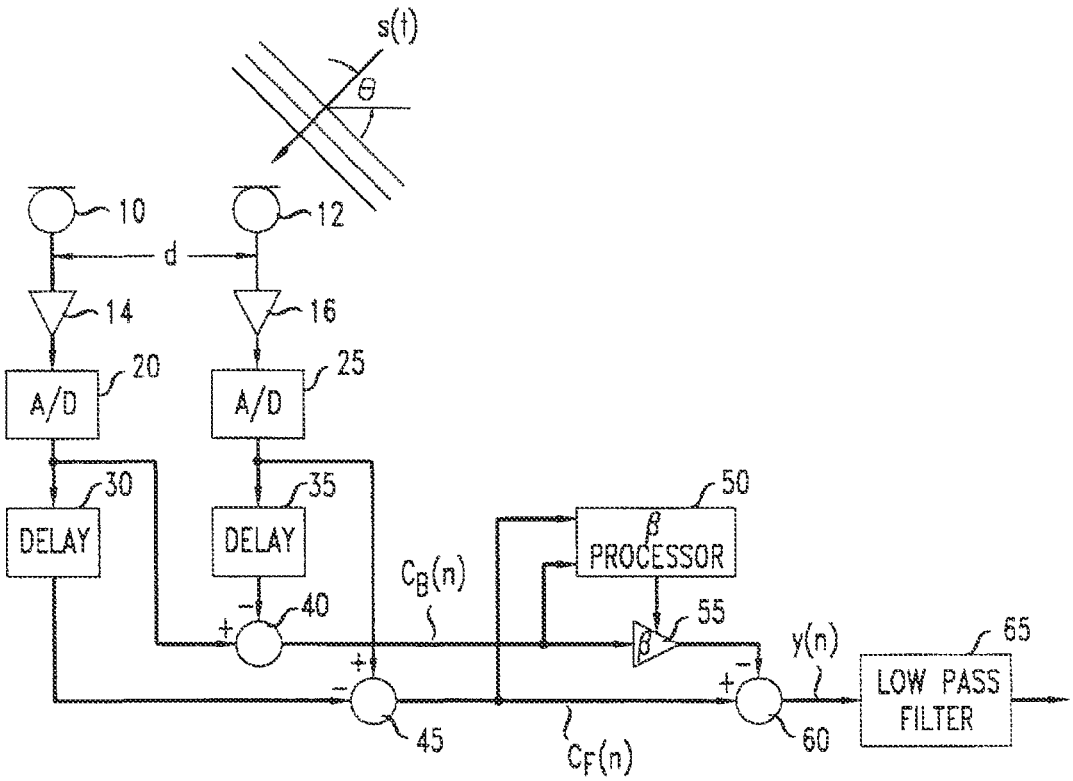

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-23 are cancelled.

* * * * *